US006623578B2

(12) United States Patent
Wasitis et al.

(10) Patent No.: US 6,623,578 B2
(45) Date of Patent: Sep. 23, 2003

(54) PENETRATION POCKET AND METHOD OF MANUFACTURING THE SAME

(75) Inventors: William A. Wasitis, Indianapolis, IN (US); Daniel L. Barksdale, Brownsburg, IN (US)

(73) Assignee: BFS Diversified Products, LLC, Carmel, IN (US)

( * ) Notice: Subject to any disclaimer, the term of this patent is extended or adjusted under 35 U.S.C. 154(b) by 170 days.

(21) Appl. No.: 09/766,862

(22) Filed: Jan. 19, 2001

(65) Prior Publication Data

US 2002/0096242 A1 Jul. 25, 2002

(51) Int. Cl.[7] ..... E04D 13/14

(52) U.S. Cl. ..... 156/71; 52/199; 52/219; 52/741.4; 52/742.13

(58) Field of Search ..... 156/71; 52/199, 52/219, 741.4, 742.13

(56) References Cited

U.S. PATENT DOCUMENTS 3,436,880 A * 4/1969 Kifer ..... 138/96 R
3,838,544 A * 10/1974 Hindall ..... 52/219
3,977,137 A * 8/1976 Patry ..... 285/42
4,730,421 A 3/1988 Leeland
4,928,443 A 5/1990 Goodman et al.
4,934,117 A 6/1990 Barksdale
5,018,748 A * 5/1991 Schalle ..... 277/634
5,493,827 A 2/1996 Georgeau et al.
5,535,559 A * 7/1996 Nielsen et al. ..... 285/189
5,768,838 A 6/1998 Georgeau
5,970,667 A * 10/1999 Thaler ..... 285/42
6,021,620 A * 2/2000 Vermilion et al. ..... 52/199
6,185,885 B1 * 2/2001 Thaler ..... 285/42

* cited by examiner

*Primary Examiner*—Mark A. Osele
(74) *Attorney, Agent, or Firm*—Timothy Nauman

(57) ABSTRACT

A penetration pocket assembly and method of forming same for sealing the joint between a membrane covering a roof structure and an element projecting therethrough. A rigid ring is placed inside a polymeric boot which is equipped with an upper and lower flange. The ring is positioned so that an upper edge fits into the boot upper flange. The ring/boot assembly is then located on the membrane surrounding the projecting element. The ring is sealed to the membrane with an adhesive and a pourable waterproof sealant fills the area within the ring, bonding to the inside surface of the ring, the boot upper flange, the exterior surface of the projecting element, and the membrane.

15 Claims, 3 Drawing Sheets

PENETRATION POCKET AND METHOD OF MANUFACTURING THE SAME

BACKGROUND OF THE INVENTION

In the construction of many types of low slope roofs, a water impervious upper layer covering the surface of the roof is commonly used to prevent water from penetrating the roof structure. Although different materials are used depending on the type of roof constructed, this waterproof layer or surface is generally referred to as a roof membrane.

Roofs often have one or more elements extending upwardly and physically penetrating or extending through the membrane. These elements include vents, conduits or support members. Where these elements extend through the roof, they pierce the roof membrane and define potential leak paths for water to penetrate through the membrane. To prevent water from leaking or migrating through the membrane at these points, special care must be taken to seal the hole created in the membrane by the penetrating element.

One common technique of accomplishing this is by using a penetration or pitch pocket. The penetration pocket is essentially a rigid structure mounted to the roof that surrounds the penetration element. This rigid structure is then filled with a pourable sealer. The penetration pocket itself must then be sealed or flashed to ensure that no water enters under the seal.

Various types of penetration pockets have been contemplated. One type includes a metal band attached to a strip of an elastomer with an adhesive applied to the elastomer. The metal band is shaped into a ring and placed on a roof membrane around a penetration element. A lower part of the elastomer extending below a bottom edge of the metal band is folded such that it forms a flange around the outside of the metal band parallel to the roof membrane and extending radially outward from the band. A pourable sealer is introduced into the metal band to fill the area within the ring. This pocket is relatively simple to produce but can be time consuming to install due to the necessity of applying a flashing strip to the area where the elastomer overlaps itself.

Another type of penetration pocket uses a tubular body surrounding the penetration, the tubular body having its own pre-formed peripheral base. A separate collar surrounds and extends above an outer edge of the tubular body. A bottom wall of the collar is equipped with openings and is situated below an upper edge of the tubular body to form a trough between the body and the collar. A porous material is placed in the trough and a waterproof sealant is added to the pocket. This pocket is relatively complex and expensive to produce.

Another known penetration pocket includes an annular rigid ring surrounding the penetration. A flashing strip of rubber is secured to the rigid ring and the roof membrane by an adhesive. A waterproof sealant fills a space between the rigid ring and the penetration. The required use of an adhesive to secure the flashing strip to the ring makes the assembly of this pocket time consuming. In addition, the pocket may leak if the adhesive is not applied correctly.

Although prior penetration pockets may provide satisfactory results, they have certain inherent disadvantages. Many are relatively complex and expensive to produce. The use of flashing strips increases production costs and installation time. In addition, many require additional installation steps and the application of multiple adhesive layers, thus making them labor intensive. In addition, the greater the complexity of installation, the greater the chance that a leak will develop as a result of improper installation.

The majority of prior pockets are also quite limited in their application. By using rings and seals of predetermined diameter, they are incapable of being used when the shape of the penetration does not allow the materials to pass over the top of the penetration. This is quite often the case when fans or manifolds are fit over the penetration. Also, some prior methods require the use of anchors or fasteners to secure the penetration pocket to the roof structure. The fasteners pierce the membrane and introduce additional potential avenues for water to leak through to the roof deck.

BRIEF SUMMARY OF THE INVENTION

The present invention provides a penetration pocket and installation procedure using an inexpensive rigid ring and a polymeric pre-molded boot.

The boot is placed around the ring and the boot/ring assembly is then placed around a penetration element. An upper flange on the boot fits snugly over the top edge of the ring, ensuring the integrity of the seal. The pre-molded boot is equipped with a lower flange which acts as flashing for the ring. An adhesive tape pre-installed on the bottom side of the lower flange allows the boot to be sealed to the roof membrane. This eliminates the need for anchors or fasteners to attach the pocket to the roof structure. The combination of the upper and lower flange on the boot eliminates the need to install a formable flashing around the ring, as well as eliminating the need for an adhesive to be applied to the outside of the ring.

Another aspect of the present invention is that the penetration pocket can be formed around penetrations that are in place but do not allow for the boot to be slipped over the top. The rigid ring is cut to allow it to be spread around penetrations. The presence of the rigid ring permits an installer to cut the boot and fit it around penetrations. Without a ring, such a boot is not rigid enough to allow it to be cut and placed around a penetration and must be used with only those penetrations over which it can fit while uncut.

DETAILED DESCRIPTION OF THE INVENTION

Figure 1:
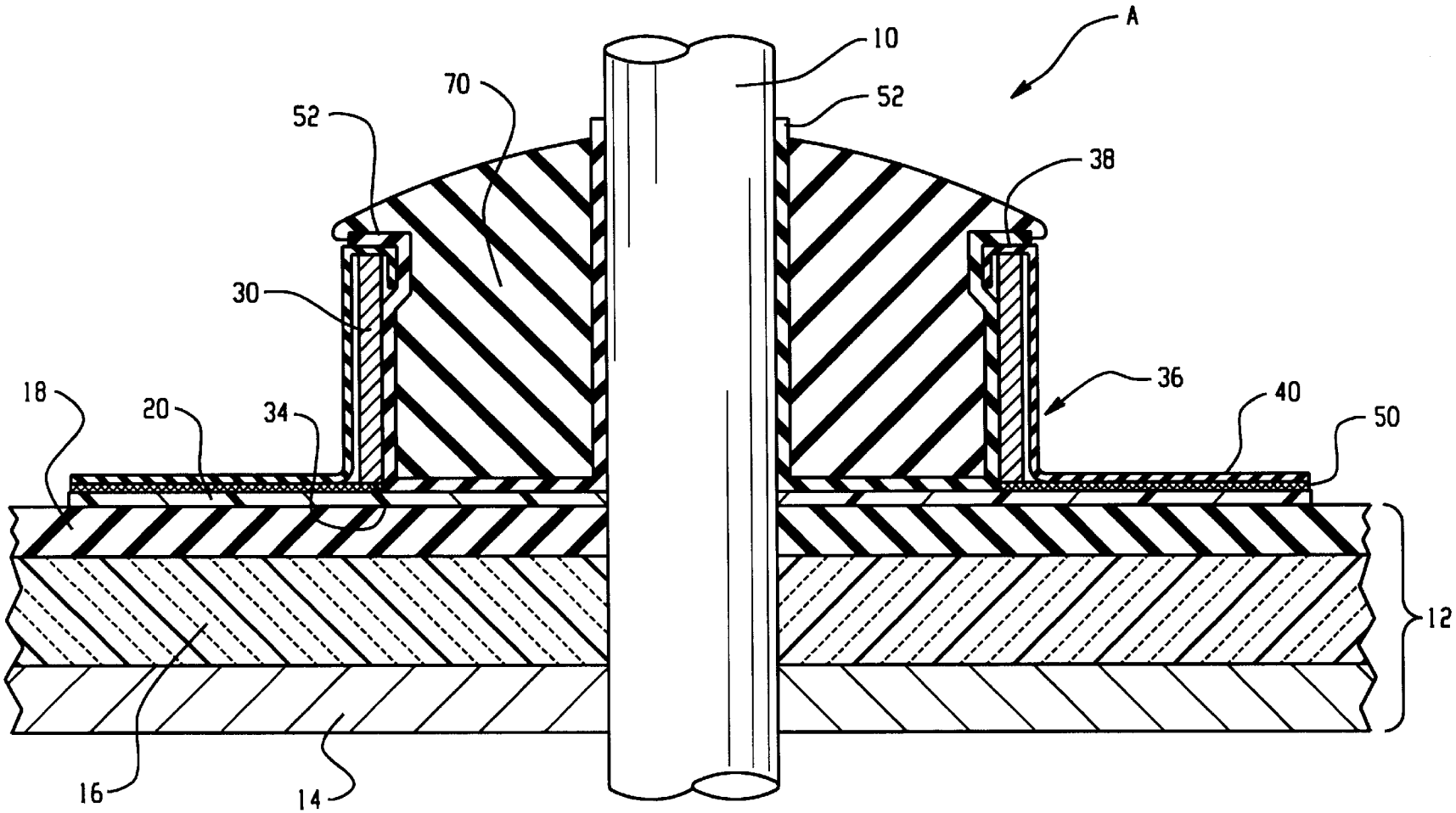
FIG. 1 is a sectional view of an assembled penetration pocket seated around a roof penetration.

With reference to FIG. 1, a penetration pocket assembly is shown in accordance with the present invention. A penetration element 10 is shown that pierces a roof structure 12, the roof structure comprising a roof deck 14, an insulation layer 16 and a waterproof membrane 18.

Prior to assembly of the penetration pocket, an area of the waterproof membrane on which the assembled penetration pocket will be seated is cleaned. A preferred method of accomplishing this is by applying a layer of primer 20 to the membrane, although other cleaning methods can be used without departing from the scope and intent of the invention. An appropriately sized diameter rigid ring 30 with a first end or top edge 32 and a second end or bottom edge 34 is placed inside a polymeric pre-molded boot 36. As evident in FIG. 1, the ring is preferably a hollow cylinder while the boot is equipped with an upper flange 38 and a lower flange 40. The upper flange 38 includes a radial portion 38*a* (FIG. 2) that overlies the top edge 32 of the ring and an axial portion 38*b* that extends for a short dimension within the inner diameter of the ring. This conformation of the upper flange 38 forms a cap over the ring that provides positive location between the ring and boot components and effectively limits the potential for a leak path to be formed therebetween. A sidewall of the polymeric boot has a cylindrical configuration in the preferred embodiment, although other conformations may be used if desired. The ring is cut through at one point along its circumference to provide additional dimensional flexibility, although a series of partial cuts could also be used, as will be described in greater detail below.

Figure 2:
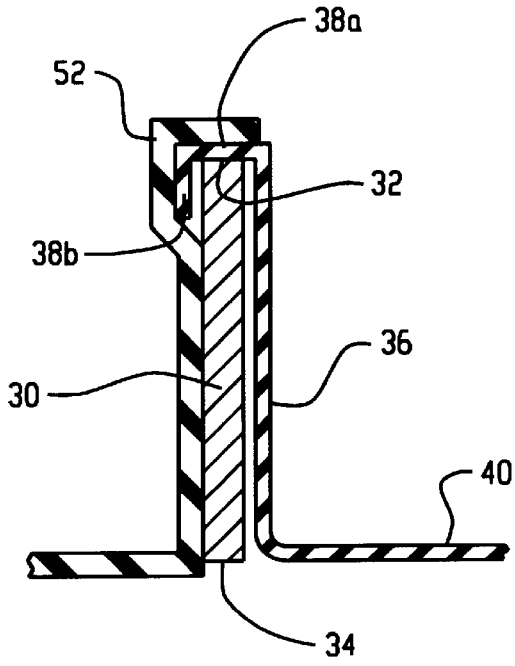
FIG. 2 is an enlarged sectional view of a portion of FIG. 1.
Figure 3:
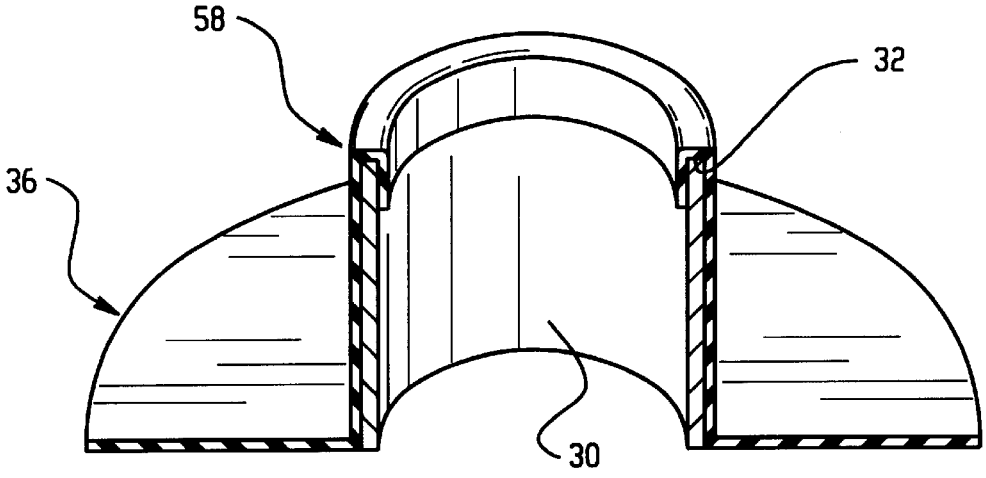
FIG. 3 is a cutaway view of a boot/ring assembly.

As is easily seen in FIG. 2, the boot is located over the ring such that the top edge 32 of the ring abuts inside the upper flange 38 of the boot. The boot upper flange is sized such that a compression seal is formed between the boot and the ring, holding the ring firmly in place. Again, this limits the potential for any leak path to be formed between the assembled components and also secures the components together for stability.

Referring again to FIG. 1, an underside of the lower flange is preferably equipped with an adhesive tape 50 protected by release paper. Once the primer has cured or dried, the release paper is removed and the boot/ring assembly is placed over the penetration element such that the bottom edge of the ring and the bottom side of the flange rest securely on the waterproof membrane. The boot/ring assembly is positioned around the penetration element such that the penetration element is centered in the area defined by the boot/ring assembly. The tape on the bottom of the boot lower flange adheres to the membrane surface using, for example manual pressure. A roller is subsequently used to ensure that a waterproof seal is formed. As will be appreciated, use of a pre-applied adhesive tape on the lower flange 40 eliminates the need for a solvent-based adhesive to be applied to the outside of the pre-formed rigid ring, thereby simplifying assembly, reducing installation time and expense, and reducing the potential for incorrect installation.

Figure 4:
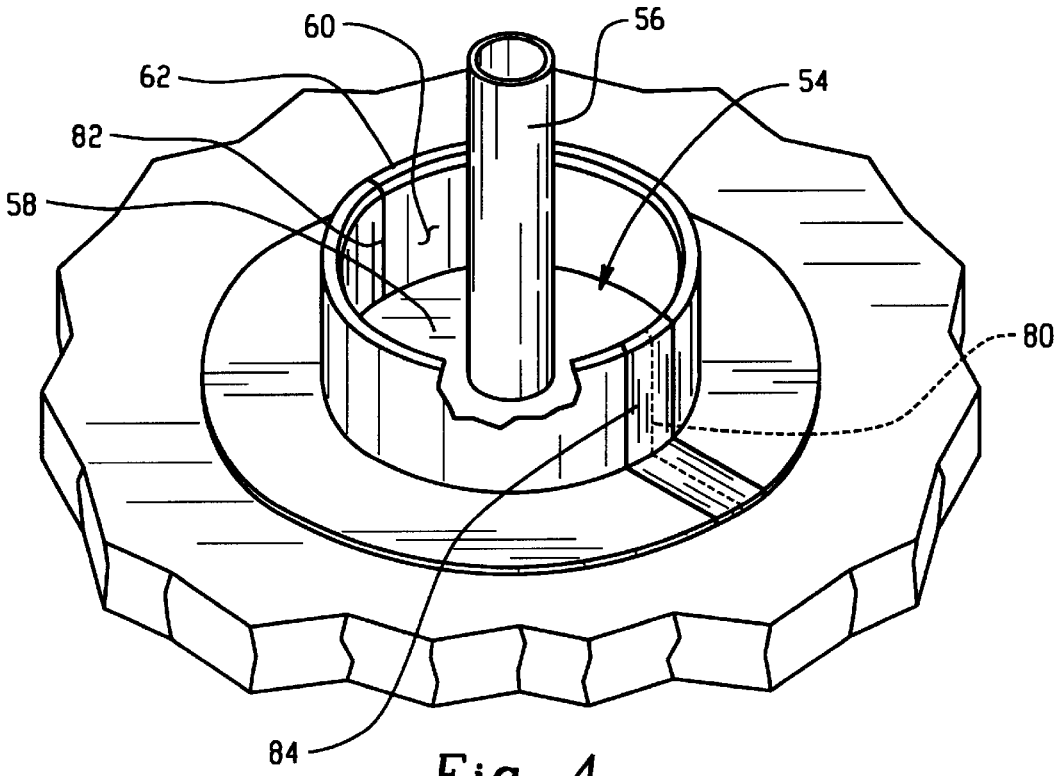
FIG. 4 shows a perspective view of a penetration pocket with flashing installed over a cut in the boot prior to adding sealant to the pocket.
Figure 5:
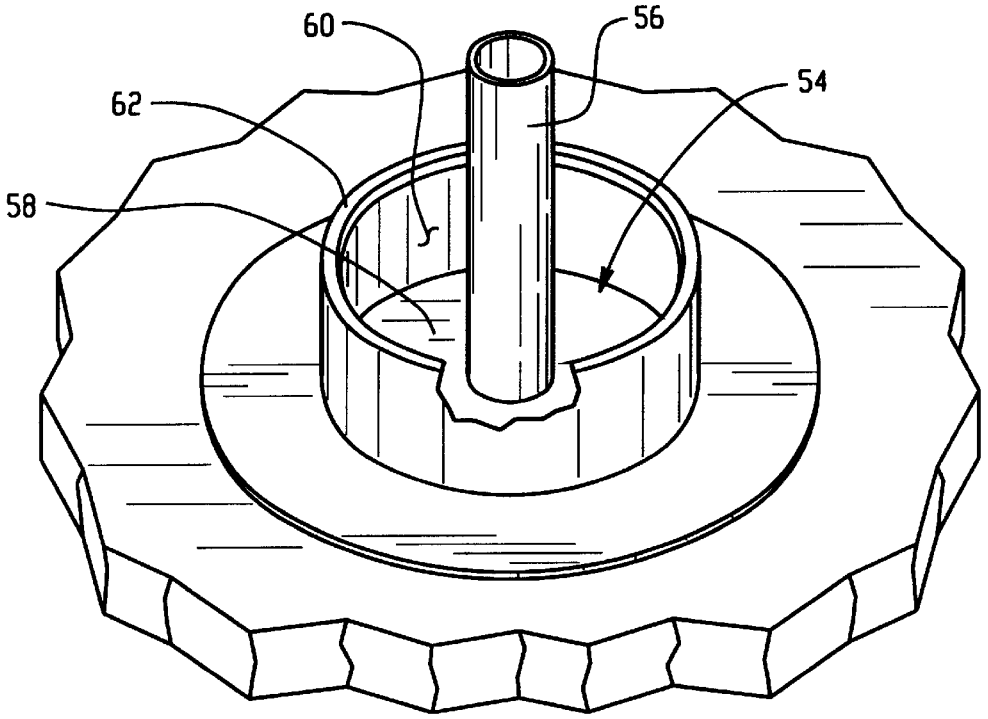
FIG. 5 is a perspective view of a penetration pocket attached to a roof prior to adding sealant to the pocket.

With reference to FIGS. 1, 2, and 4, a conventional primer or an adhesive 52 is preferably applied to a cavity 54 defined by the boot/ring assembly and the penetration element. The primer or adhesive is advantageously applied so that it covers an outside surface 56 of the penetration element, the area 58 of the waterproof membrane between the penetration element and the ring, the inside surface 60 of the ring, and the top 62 of the upper flange of the boot. As illustrated in FIG. 2, the primer or adhesive 52 covers any potential leak path between the boot and ring assembly. In addition, the primer or adhesive is preferably applied on the penetration element to an extended height (FIG. 1) relative to the height of the boot/ring assembly.

A waterproof sealant 70 is subsequently added to the cavity defined by the boot/ring assembly and the penetration element. The sealant is preferably pourable but of sufficient viscosity that it is not self-leveling or free-flowing, i.e., the sealant can be mounded into shape and retain the shape until cured. One commercially available sealant is a two-part polyurethane which cures in a relatively short time. The viscosity of the sealant permits the installer to form the sealant upper surface and define a grade or slope slightly downward from the penetration element to an outer edge of the upper boot flange 62 such that it will shed water away from the penetration element. Upon curing, the sealant hardens to form a waterproof barrier in the cavity.

When the penetration pocket is used with a penetration element that does not have an upper end that the ring and boot can readily fit over, the ring can be spread apart and placed around the element without affecting the concept or practice of the invention. To that end, the boot is cut through along its circumference and advantageously spread around the ring. As shown in FIG. 4, the boot is seated around the ring such that a cut 80 in the boot is located substantially opposite a cut 82 in the ring. To seal the cut in the boot, a primer or adhesive is applied to the area on the boot to be flashed and the inside wall of the ring where the flashing will be adhered. A portion or piece 84 of compatible polymeric formable flashing is next installed over the boot and adhered to the primer or adhesive. The flashing extends over the upper flange of the boot and adheres to the inside wall of the ring. The penetration pocket is subsequently sealed by applying an adhesive to the cavity 54 and adding a sealant 70 as described above.

The present invention advantageously uses a polymeric pre-molded boot and pourable sealer. A pre-formed ring provides rigidity to the flexible boot so that any fabricated cuts in the boot may be flashed successfully prior to adding the pourable sealer around the penetration. The combination of a pre-molded boot with an adhesive tape on the flange simplifies the installation of the pocket. With the pre-formed rigid ring, for example cut through in one place, located inside the boot, a desired circular shape is formed to hold the pourable sealer in place until it sets up to form a seal around the penetration. Also, by having the pre-formed rigid ring inside the boot, the boot can be cut through and fit around penetrations that are in place but do not allow for the boot to be slipped over the top thereof Further, offering the components in a kit including several pre-molded boots, pre-formed rigid rings, a stirring paddle, rubber gloves and instructions facilitates installation since the installer does not have to secure these items separately and fabricate them into a desired penetration pocket.

The invention has been described with reference to the exemplary embodiments. Modifications and alterations will occur to others upon reading and understanding the specification. For example, the rigid ring is preferably made from a rigid plastic material such as PVC or ABS; however, other plastics may be used. The invention is intended to include such modifications and alterations insofar as they come within the scope of the appended claims.

What is claimed is:

1. A method of forming a penetration pocket for sealing the joint between a membrane covering a roof structure and a penetration element projecting through the membrane, the method comprising the steps of:

cutting through a rigid ring along its perimeter;

spreading the ring apart for installation around the penetration element;

cutting a pre-molded polymeric boot having an upper and lower flange, the cut to be completely through the boot and made at one point along its perimeter;

installing the boot around the penetration element;

seating the boot adjacent the ring so that the ring is inside the boot upper flange, an inner area of the boot upper flange being smaller than a ring thickness such that the boot exerts a compressive force on the ring and holds the ring in place;

locating the boot lower flange on the membrane surface;

applying an adhesive to the cavity formed by the penetration element, the membrane and the liner surface of the ring;

filling the cavity wit a sealant; and, applying an adhesive to the hoot in the area on both sides of the cut in the boot.

2. The method of claim 1, comprising the further step of installing flashing material over the adhesive and along the cut in the boot and extending over the boot upper flange and down the inside surface of the ring.

3. The method of claim 1, in which the sealant is graded such that it slopes downwardly from the projecting element to the outer edge of the top of the boot upper flange.

4. The method of claim 1, comprising the further step of placing the ring and boot around the penetration element such that the penetration element sits approximately at the center of the area defined by the ring.

5. The method of claim 1, comprising the further step of adhering the boot to the membrane with an adhesive tape on the bottom side of the boot lower flange.

6. The method of claim 1, comprising the further step of locating the cut in the ring and the cut in the boot substantially opposite one another.

7. The method of claim 1, further comprising applying adhesive to the inside of the ring corresponding to the area on the ring adjacent the cut on the boot.

8. The method of claim 1, comprising the further step of cleaning the area of the membrane from the penetration element to just beyond the diameter of the boot lower flange.

9. A penetration pocket for sealing the joint between a membrane covering a roof structure and a penetration element projecting through the membrane, the penetration pocket comprising:

a pre-formed ring having curved inner and outer surfaces and a top and bottom edge, the ring disposed on the membrane such that it surrounds the penetration element;

a flexible pre-molded polymeric boot abutted against the outside surface of the ring having an upper flange that fits around a top of the rigid ring such that a compression seal is formed between the upper flange and the ring, the boot having a lower flange by which it contacts the membrane, the boot cut to permit the boot to fit around the penetration element;

an adhesive provided on the inside surface of the ring, the outside surface of the penetration element, the membrane extending between the ring and the element, and on the boot in the area on both sides of the cut; and a sealant filling the cavity defined by the exterior surface of the penetration element, the membrane and the ring.

10. The penetration pocket of claim 9, further comprising flashing material positioned along the cut in the boot over the adhesive and extending over the boot's upper flange and down the inside surface of the ring.

11. The penetration pocket for claim 9, in which the ring is formed of a plastic material.

12. The penetration pocket of claim 9, in which the ring is cut through such that it can be spread to fit among a penetration element.

13. The penetration pocket of claim 9, in which an adhesive tape is applied to the lower flange of the boot to adhere the boot to the membrane and form a seal when assembled.

14. The penetration pocket of claim 9, in which the sealant is pourable when filling the cavity and subsequently hardens upon curing.

15. The penetration pocket of claim 9, wherein the adhesive is a high solids primer.

* * * * *

UNITED STATES PATENT AND TRADEMARK OFFICE

CERTIFICATE OF CORRECTION

PATENT NO. : 6,623,578 B2
DATED : September 23, 2003
INVENTOR(S) : William A. Wasitis et al.

It is certified that error appears in the above-identified patent and that said Letters Patent is hereby corrected as shown below:

Column 5,
Line 2, delete the word "hoot" and replace it with the word -- boot. --

Signed and Sealed this

Ninth Day of December, 2003

JAMES E. ROGAN
*Director of the United States Patent and Trademark Office*